United States Patent [19]

Raab et al.

[11] 4,054,761

[45] Oct. 18, 1977

[54] ELECTRICAL SWITCH COMBINED WITH FLUID CONTROL DEVICE

[75] Inventors: Andrew F. Raab, Morton Grove; Raymond T. Halstead, Wheeling, both of Ill.

[73] Assignee: Indak Manufacturing Corporation, Northbrook, Ill.

[21] Appl. No.: 658,615

[22] Filed: Feb. 17, 1976

[51] Int. Cl.[2] ..... H01H 15/06

[52] U.S. Cl. ..... 200/16 C; 200/61.86

[58] Field of Search ..... 200/11 DA, 11 TW, 16 C, 200/16 D, 61.86; 137/625.11, 625.2

[56] References Cited

U.S. PATENT DOCUMENTS

| | | | |
|---|---|---|---|
| 2,710,317 | 6/1955 | Pearl | 200/16 C |
| 3,378,654 | 4/1968 | Hoy et al. | 200/16 C |
| 3,398,245 | 8/1968 | Hartsock | 200/11 DA |
| 3,809,830 | 5/1974 | Lockard et al. | 200/11 TW |
| 3,845,257 | 10/1974 | Fiddler | 200/61.86 |
| 3,934,101 | 1/1976 | Jones | 200/16 D |
| 3,942,555 | 3/1976 | Raab et al. | 200/61.86 |

*Primary Examiner*—James R. Scott

*Attorney, Agent, or Firm*—Burmeister, York, Palmatier, Hamby & Jones

[57] ABSTRACT

A combined electrical switch and fluid control device, in which the switch comprises a casing having an insulating wall, a slider movable in the casing and carrying a contactor having first and second contact points, and first and second contact bars mounted on the insulating wall opposite the contactor, the first bar being engageable by the first contact point, the first and second bars having first and second segments projecting laterally therefrom for successive engagement by the second contact point, the first and second segments having a narrow gap therebetween of less width than the width of the second contact point, whereby such point wll ride between such segments without engaging the insulating wall to avoid burning of such wall and to avoid contamination of the second contact point by such wall.

6 Claims, 17 Drawing Figures

ELECTRICAL SWITCH COMBINED WITH FLUID CONTROL DEVICE

This invention relates to control devices for controlling both fluid power and electrical power simultaneously. The control devices of the present invention will find many applications, but are particularly well adapted for controlling vacuum operated devices and electrically operated devices on an automobile or some other vehicle. For example, the control device of the present invention may be employed to control the operation of a heating and air-conditioning system on an automotive vehicle. For this particular service, the control devices may be employed to control one or more electrically operated motors and clutches, as well as one or more vacuum operated diaphrams which may be employed to operate valves, dampers, shutters and the like.

One object of the present invention is to provide a new control device which, in cetain aspects, is an improvement over the combined electrical switch and fluid control device disclosed and claimed in the copending application of Andrew F. Raab and Jesse M. Cobb, Ser. No. 454,320, filed Mar. 25, 1974 now U.S. Pat. No. 3,942,555.

A further object is to provide a new and improved control device of the foregoing character, in which the movable valve carriage or member is operated by the electrical carriage or slider and is also retained in its operative position by such slider, without any need for any additional retaining member, so that the complexity and cost of the control device are reduced, while increasing the reliability and durability of the device.

To achieve these and other objects, the control device may comprise a casing having a first slideway therein, a slider movable in the casing along the slideway, electrical switching means on the slider and the casing for carrying out electrical switching functions, the casing having a valve slideway recessed into the casing from the first slideway and extending transversely thereto, a valve member movable in the valve slideway, cooperative valve elements on the valve member and the casing for carrying out fluid control functions in response to movement of the valve member along the valve slideway, cooperative camming elements on the valve member and the slider for moving the valve member along the valve slideway in response to movement of the slider along the first slideway, a first position maintaining surface on the valve member, and a second position maintaining surface on the slider, the second position maintaining surface being directly and slidably engaged with the first position maintaining surface throughout the entire range of movement of the slider and the entire range of movement of the valve member for maintaining the position of the valve member in the valve slideway with the valve elements in their cooperative relationship. The first and second position maintaining surfaces preferably have overlapping portions which are substantially in excess of fifty percent of the first position maintaining surface throughout the entire ranges of movement of the slider and the valve member.

The valve elements may include means on the casing forming a plurality of valve ports, a slide valve element on the valve member and slidable over the ports, and resilient means acting between the slide valve element and the valve member for biasing the slide valve element against the casing while also biasing the valve member against the slider. The first slideway preferably includes means for maintaining the slider in a stable orientation throughout the entire range of movement of the slider. Resilient pressure is maintained between the first and second position maintaining surfaces by the resilient means, throughout the entire ranges of movement of the valve member and the slider.

The electrical switching means may include first electrical contact elements on the casing and opposite the path of movement of the slider, and second electrical contact elements movable with the slider and engageable with the first electrical contact elements to perform electrical switching functions in response to movement of the slider. Preferably, the control device includes resilient means acting between the slider and the second electrical contact elements for biasing the second electrical contact elements into engagement with the first electrical contact elements while biasing the slider toward the valve member.

Further objects, advantages and features of the present invention will appear from the following description, taken with the accompanying drawings, in which.

As just indicated, the drawings illustrate a combined electrical switch and fluid control device 20, adapted to control both electrical components, such as motors and clutches, and fluid operated devices, such as vacuum responsive diaphragms for operating valves, dampers and shutters. The illustrated control device 20 is particularly well adapted for use on an automobile or some other vehicle, to control the heating and air-conditioning system for the vehicle. In such a system, the control device 20 may be employed to control a fan motor, an electrically operated clutch to drive the air-conditioning compressor, a vacuum operated temperature valve or other device, and one or more vacuum operated function control devices.

Figure 1:
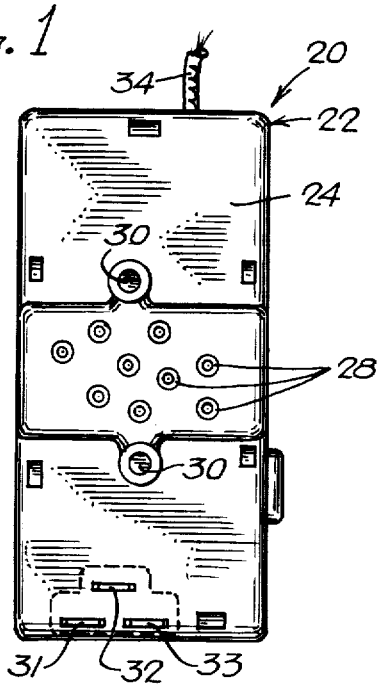
FIGS. 1, 2 and 3 are rear, side and front elevational views of a combined electrical and fluid control device, to be described as an illustrative embodiment of the present invention.

As illustrated in FIGS. 1–9, the control device 20 has a casing 22, which may comprise a body 24 and a front cover 26. The control device 20 is adapted to be connected to both the vacuum powered control system and the electrical system of the vehicle. Thus, the body 24 of the casing 22 is provided with a cluster of nipples 28 for connecting the control device 20 to the vacuum powered control system. As shown in FIG. 1, there are nine such nipples 28 in this case. Adjacent the cluster of nipples 28, the body 24 of the casing 22 is provided with a pair of locating pins 30. The nipples 28 and the locating pins 30 are adapted to receive a suitable connector, not shown, to establish disengageable connections between the nipples 28 and a plurality of tubes or hoses, leading to various components of the vacuum powered control system.

The illustrated control device 20 is also provided with a plurality of electrical terminals for connecting the control device to the electrical control system. As shown to best advantage in FIGS. 1 and 2, three electrical terminal prongs 31, 32 and 33 project rearwardly from the casing 22. The control device 20 has an additional terminal in the form of a lead or wire 34, extending out of the casing 22.

Figure 2:
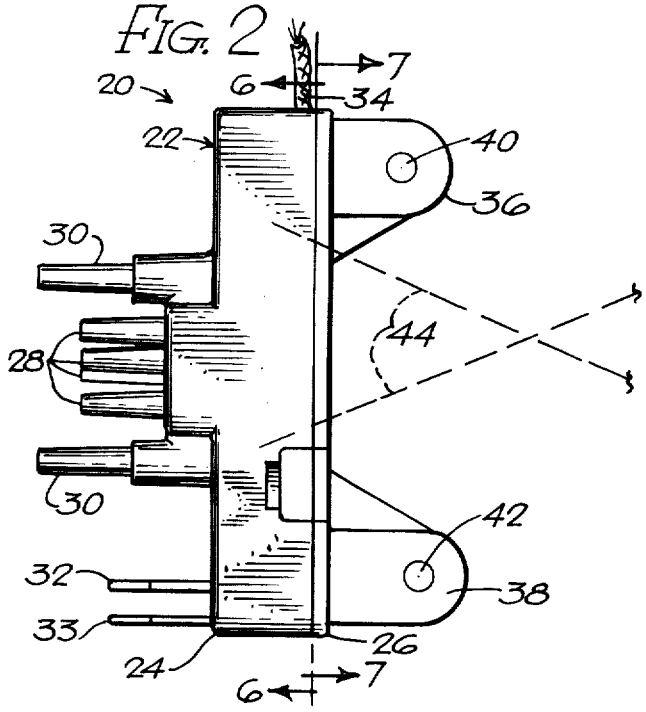
Figure 16:
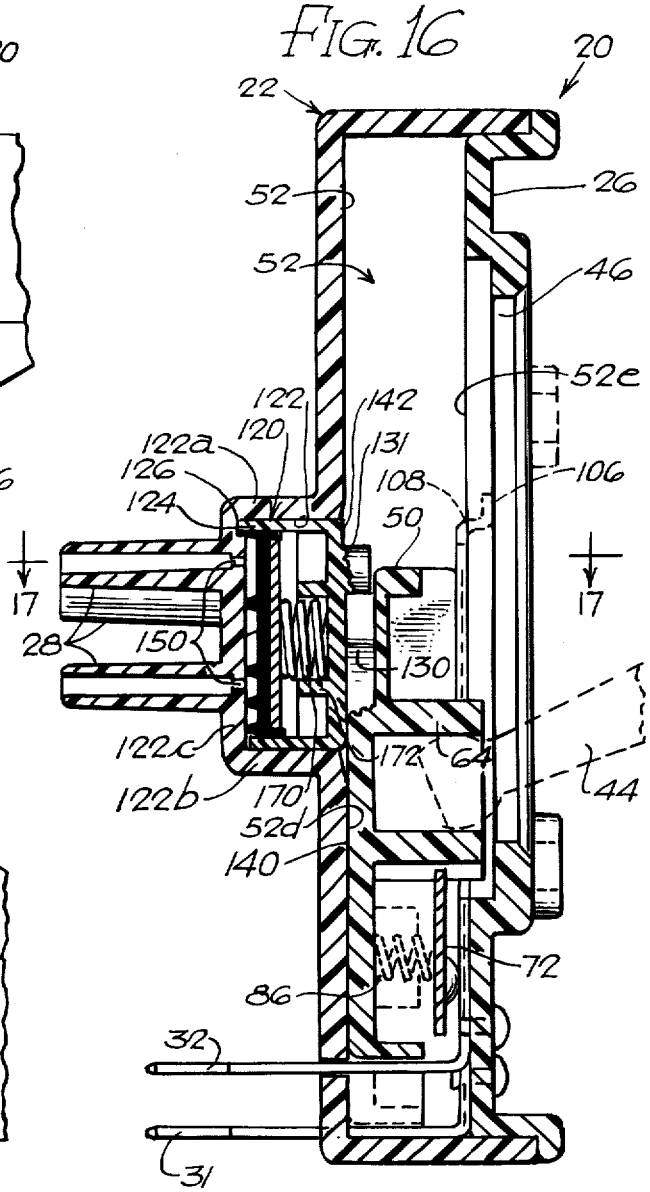
FIG. 16 is a different longitudinal section, taken generally along the line 16—16, shown in FIGS. 3, 6 and 17.
Figure 17:
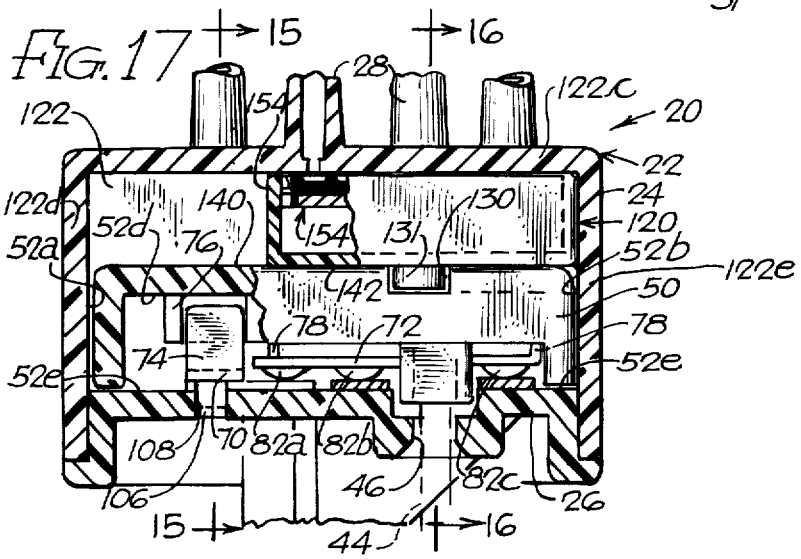
FIG. 17 is a transverse section taken through the control device, generally along the line 17—17, shown in FIGS. 3 and 16.

The front cover 26 of the illustrated control device 20 is provided with integral brackets 36 and 38, having openings 40 and 42 therein for mounting the control device 20 on a control lever assembly, not shown, including a control lever 44, indicated by broken lines in FIGS. 2, 16 and 17. The control lever 44 is adapted to be operated manually or otherwise, to adjust the control device 20. A slot 46 is formed in the front cover 26 to admsit one end of the control lever 44. The front cover 26 is suitably secured to the body 24 of the casing 22.

It will be understood that the body 24 and the front cover 26 of the casing 22 may be molded or otherwise made from a resinous plastic material, or any other suitable material. The lever 44 may be made of metal.

The internal construction of the control device 20 is shown in FIGS. 6–17. The control device 20 employs a control slider or carriage 50, adapted to control the electrical switching functions and also the fluid control functions of the control device 20. The control slider 50 is shown to best advantage in FIGS. 6, 10, 15, 16 and 17. The slider 50 is movable along a predetermined path in the casing 22. In this case, the control slider 50 is guided along a linear path defined by a slideway 52 in the casing 22.

As shown in FIGS. 6, 8, 9, 15, 16 and 17, the slideway 52 for the control member or slider 50 is formed by surfaces or walls on the body 24 and the front cover 26 of the casing 22, including sidewalls **52*a* and *b* and rearwall elements 52*c* and *d* on the body 24, and a rearwardly facing longitudinal surface 52*e* on the front cover 26. The illustrated slider 50** is generally rectangular in shape and may be molded or otherwise formed from a resinous plastic or some other suitable material.

Figure 6:
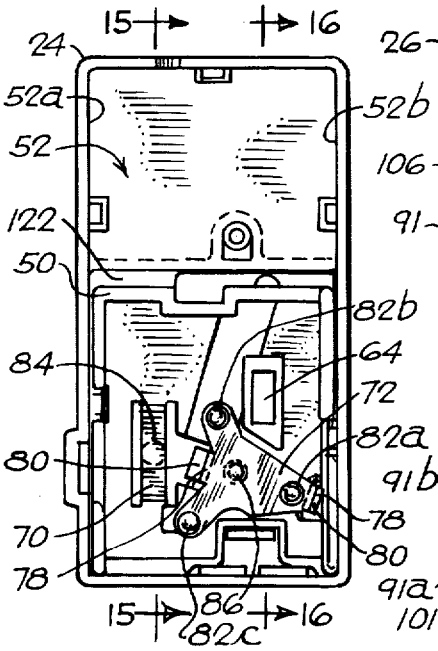
FIG. 6 is a front view of the control device with the front cover plate removed, to show details of the electrical slider and the electrical contact elements mounted thereon, the view being taken generally as indicated by the line 6—6 in FIG. 2.

As previously indicated, the control slider 50 is adapted to be operated by a control lever 44, or some other control member, extending into the casing 22 through the slot 46 in the front cover 26. As shown in FIGS. 6 and 16, a slot or recess 64 may be formed in the front side of the control slider 50 for receiving the operating lever 44.

The control member or slider 50 is adapted to operate both electrical switching means and fluid control means. Various details of the electrical switching means are shown in FIGS. 6, 7, 15, 16 and 17. The control slider 50 is adapted to operate movable contact means, engageable on a selective basis with fixed contact means. While the illustrated switching means are highly advantageous, various other switching means may be employed.

As shown in FIG. 6, the illustrated control member 50 is adapted to carry movable contactors 70 and 72, which may be made of conductive material, preferably sheet copper or some other highly conductive metal. As shown, the contactor 70 is in the form of a bar or strip, having its ends formed with tabs or prongs 74, projecting rearwardly into guide slots 76, formed in the control slider or member 50, as shown in FIGS. 16 and 17.

Figure 15:
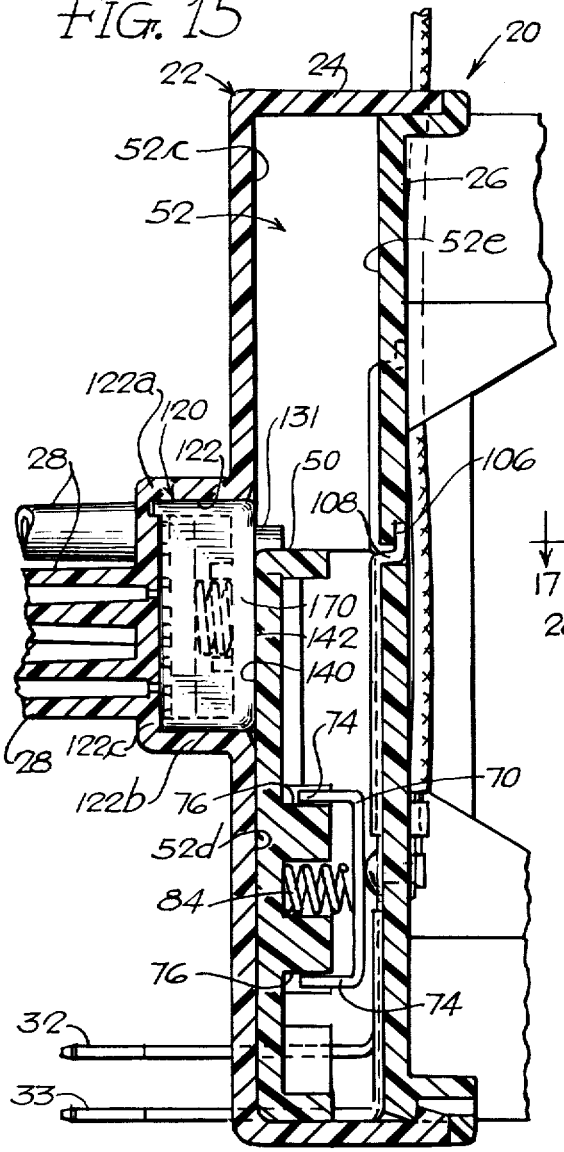
FIG. 15 is an enlarged longitudinal section taken through the control device, generally along the line 15—15, shown in FIGS. 6 and 17.

As shown in FIGS. 6, 16 and 17, the contactor 72 is preferably in the form of a generally triangular plate having tabs or prongs 78 bent rearwardly therefrom and adapted to extend into guide slots 80, formed in the control slider 50. As shown, the contactor 72 is formed with three forwardly projecting contact points **82*a*, 82*b* and 82*c* which may be spherically rounded in shape. Thus, the contactor 72 has three points of selective engagement with the corresponding fixed contact means, while the contactor 70 is adapted to have two points of selective engagement with the corresponding fixed contact means. It is preferred to provide resilient means for biasing the contactors 70 and 72 forwardly, into engagement with the fixed contact means. As shown in FIGS. 6 and 15, a resilient biasing element in the form of a spring 84 is arranged to act between the control slider 50 and the contractor 70. Another resilient biasing element in the form of a spring 86 is provided between the control slider 50 and the contactor 72, as shown in FIGS. 6 and 16**.

In the illustrated control device 20 the fixed contact means are preferably mounted within the casing 22 on the front cover 26, as shown in FIGS. 7, 15, 16 and 17. The front cover 26 may be made of an electrically insulating material, such as a resinous plastic material.

Figure 7:
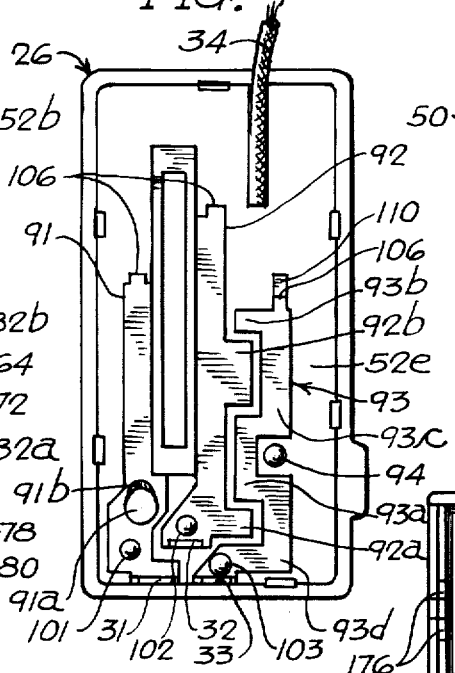
FIG. 7 is a rear view of the front cover plate, showing details of the fixed contact elements mounted thereon, the view being taken generally as indicated by the line 7—4 in FIG. 2.

As shown in FIG. 7, the fixed contact means may comprise a plurality of contact elements, including three conductive contact strips or rails 91, 92 and 93, and a contact point 94. As shown, the contact strips 91, 92 and 93 are connected to the terminals 31, 32 and 33 and are preferably formed integrally therewith. The strips 91, 92 and 93 may be made of sheet metal, such as copper, or some other highly conductive material. As shown, the wire or lead 34 is connected to the contact point 94, which may be in the form of a spherically rounded rivet head, made of copper or some other conductive material.

It will be seen from a comparison of FIGS. 6 and 7 that the contact strip 91 extends along the path of movement of the contact point **82*a* on the contactor 72. When the slider 50 is in its lowermost position, as shown in FIG. 6, the contact point 82*a* is opposite an opening 91*a* in the contact strip 91, so that the contact point 82*a* is out of electrical engagement with the strip 91. Instead, the contact point 82*a* engages the rear surface 52*e* of the electrically insulating front cover 26. As the slider 50 is moved upwardly, the contact point 82*a* engages the contact strip 91 and rides up a ramp 91*b* at the upper edge of the gap or opening 91***a*. Throughout the rest of the range of movement of the slider 50, the contact point 82*a* engages the contact strip 91. The gap 91*a* produces an off position for the circuit connected to the terminal 31.

From a comparison of FIGS. 6 and 7, it will be seen that the contact strip 92 extends along the path of movement of the contact point 82*b*. In this case, the contact point 82*b* engages the contact strip 92 throughout the range of movement of the slider 50.

The contact strip 92 has laterally projecting tabs or segments 92*a* and 92*b* which are spaced along the path of the contact point 82*c*. The contact point 82*c* engages the segment 92*a* when the carriage 50 is moved to its lowermost position, as shown in FIG. 6. The contact point 82*c* engages the segment 92*b* after the slider 50 has been moved upwardly through part of its range. The contact point 82*c* does not close any additional circuit when such contact point is engaging the segments 92*a* and *b*, because the contact point 82*b* always engages the strip 92. Thus, the segments 92*a* and *b* represent off positions of the contact point 82*c*.

The contact strip 93 has laterally projecting tabs or segments 93*a* and *b* which are along the path of movement of the contact point 82*c*. The segment 93*a* is disposed in the gap between the segments 92*a* and *b*, while the segment 93*b* is disposed upwardly beyond the segment 92*b*. When the contact point 82*c* engages the segments 93*a* and *b*, the contactor 72 forms a circuit-closing bridge between the contact strips 92 and 93. Similarly, when the contact point 92*a* engages the contact strip 91, the contactor 72 constitutes a circuit-closing bridge between the contact strips 91 and 92. In certain positions, the contactor 72 forms a bridge which interconnects all three contact strips 91, 92 and 93.

The contact point 94 is along the path of movement of the contactor 70, which engages the contact point 94 when the slider 50 is in its lowermost position, as shown in FIG. 6. The contact strip 93 has a segment 93*c* which is along the path of movement of the contactor 70. When the contactor 70 is in its lowermost position, as shown in FIG. 6, the contactor 70 engages only the contact point 94, and does not engage the contact segment 93*c*. As the slider 50 is moved upwardly, the contactor 70 comes into engagement with the contact segment 93*c*, so that the contactor 70 forms a circuit-closing bridge between the contact point 94 and the contact strip 93. As the slider 50 continues to be moved upwardly, the contactor 70 moves out of engagement with the contact point 94. The contact strip 93 has another segment 93*d* which is not engaged by the contactor 70, anywhere in its range of movement.

Figure 3:
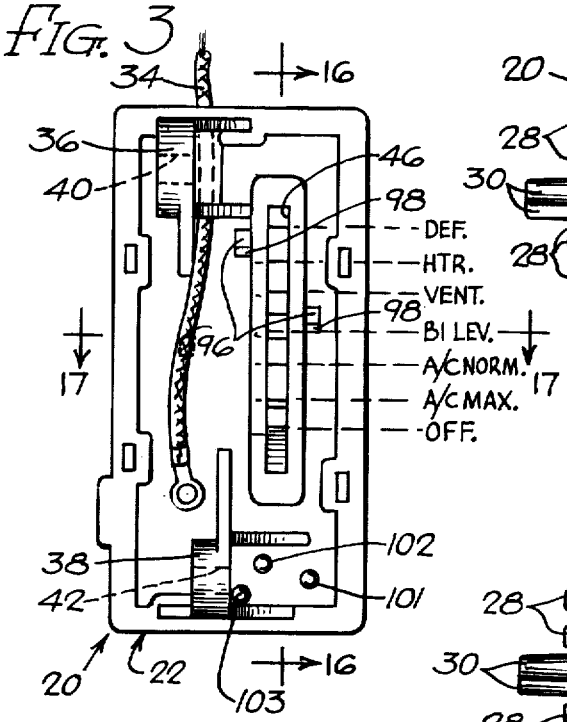
Figure 4:
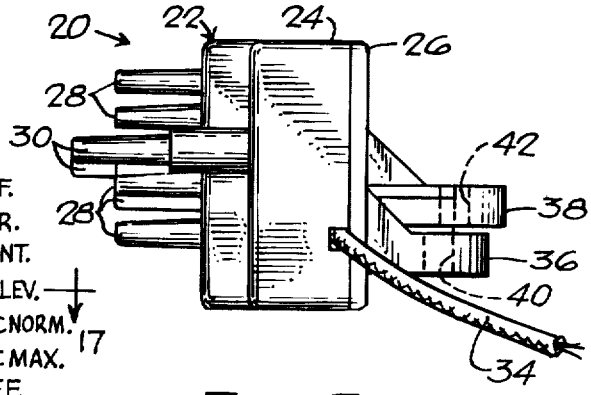
FIGS. 4 and 5 are opposite end views of the fluid control device.
Figure 5:
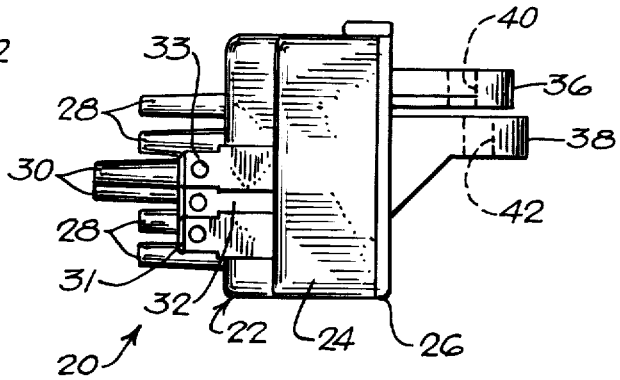

It will be evident that the electrical contact elements are capable of carrying out a variety of switching functions, in successive positions of the control slider 53 in FIG. 3, seven positions of the slider 50 are given the following labels, which indicate some of these functions: OFF, A/C MAX. (AIRCONDITIONING MAXIMUM), A/C NORM. (AIRCONDITIONING NORMAL), BI LEV. (BILEVEL), VENT. (VENTILATION), HTR. (HEATER), DEF. (DEFROST).

As shown in FIGS. 3 and 7, the contact strips 91, 92 and 93 are secured mechanically to the front cover 26 by rivets 101, 102 and 103 located close to the terminals 31, 32, and 33. The free ends of the contact strips 91, 92 and 93 are formed with L shaped anchoring tabs 106 which are securely retained in slots 108 formed in the front cover 26.

As shown in FIG. 7, an inclined ramp 110 is formed on the rear surface 52*e* of the front cover 26 at the upper end of the contact strip 93, to provide a smooth slanting transition, so that the contactor 70 will move smoothly between the contact segment 93*c* and the rear surface 52*e* of the front cover 26.

In addition to operating the switching means, the movable control member or slider 50 is adapted to operate fluid control means, adapted to establish connections on a selective basis between various fluid carrying lines, connected to the nipples 28. In this particular case, the control device 20 is especially well adapted for controlling the operation of vacuum powered diaphragms or other devices, used in connection with the heating and airconditioning system for an automotive vehicle.

The illustrated control device 20 utilizes a valve member which is movable transversely to the path of the slider 50. The valve member is adapted to be operated by camming means, interposed between the slider and the valve member.

This construction provides an extremely versatile and flexible control system. By changing the configuration of the camming means, it is possible to achieve virtually any desired relationship between the transverse movement of the valve member and the longitudinal movement of the control slider.

As shown in FIGS. 8, 15, 16 and 17, the illustrated control member 50 operates a valve member 120, slidable in a transverse slot or slideway 122, recessed rearwardly in the casing 22 from the main slideway 52. The valve slideway 122 has sidewalls 122*a* and 122*b* and a rear wall 122*c*, plus endwalls 122*d* and 122*e*, which constitute extensions of the main sidewalls 52*a* and 52*b*.

As shown in FIGS. 8, 11, 15, 16 and 17, the illustrated valve member 120 is generally rectangular in shape. In this case, a guide flange 124 projects rearwardly from the valve member 120 along one edge thereof, and is slidably received in a slot or groove 126, recessed rearwardly into the rear wall 122*c* along the sidewall 122*a*. The flange 124 has a close sliding fit in the groove 126, so that the valve member 120 is accurately guided along its path of movement in the slideway 122.

Figure 10:
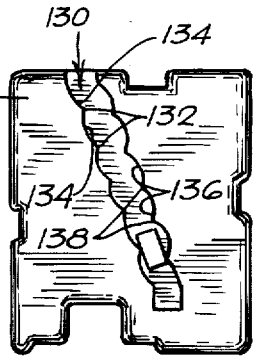
FIG. 10 is a rear view of the electrical slider.

The camming means for the valve member 120 may take the form of a cam track 130 in the control slider or member 50, as shown in FIGS. 10, 16 and 17. A cam follower is provided on the valve member 120, in the form of a forwardly projecting pin or lug 131. As shown in FIG. 10, the cam track 130 takes the form of a cam slot formed in the rear side of the control slider 50. The cam track 130 extends in a generally longitudinal direction, but deviates laterally in accordance with the transverse movement to be imparted to the valve member 120 when the control slider 50 is moved along its longitudinal path.

It will be evident from FIG. 10 that the sides of the cam track or groove 130 are somewhat sawtoothed or barbed. As disclosed and claimed in the co-pending application of Andrew F. Raab and Jeese M. Cobb, Ser. No. 454,320, filed Mar. 25, 1974, one side of the groove 130 comprises a series of points or barbs 132 alternating with rounded hollows or notches 134. The points 132 are also preferably rounded but with a considerably smaller radius than that of the rounded hollows 134. Similarly, the other side of the cam groove 130 is formed with a series of rounded hollows or notches 136, alternating with points 138.

It will be seen that the points 132 and hollows 134 on one side of the cam track 130 are staggered relative to the points 138 and hollows 136 on the opposite side of the cam track 130. Thus, the points 132 on one side of the cam track 130 are opposite the hollows 136 on the opposite side. Similarly, the hollows 134 on the first side of cam track 130 are opposite the points 138 on the second side.

The provision of the staggered points and hollows imparts a sawtoothed shape to each sidewall of the cam track 130, while causing the cam track to zigzag to a small but appreciable extent. This zigzagging of the cam track 130 produces overtravel of the cam follower 131, so as to compensate for lost motion or play between the cam track and the cam follower. This construction is disclosed and claimed in the previously mentioned Raab and Cobb application.

The transversely movable valve member 120 retained in the valve slideway 122 by the control member or slider 50, without any need for any additional retaining means. As shown to best advantage in FIGS. 15, 16 and 17, the control slider 50 has a rearwardly facing position maintaining surface 140 which slidably engages a forwardly facing position maintaining surface 142 on the valve member 120. The slidable engagement between the position maintaining surfaces 140 and 142 is maintained throughout the range of movement of the slider 50, and also throughout the range of movement of the valve member 120, so that the position of the valve member 120 in the valve slideway 122 is accurately maintained at all times. The position and orientation of the control slider 50 are accurately maintained by the slideway 52 throughout the range of movement of the slider 50. The first position maintaining surface 140 on the slider 50 overlaps the second position maintaining surface 142 on the valve member 120 at all times to a sufficient extent to maintain the position of the valve member 120 in the valve slideway 122 with a high degree of accuracy, throughout the ranges of movement of the members 50 and 120. This overlapping of the position maintaining surfaces 140 and 142 is always substantially in excess of 50% of the surface 142, so that the valve member 120 is maintained in a stable and accurate position at all times. In the case of the specific construction shown in FIGS. 15, 16 and 17, this overlapping is always equal to or greater than approximately 80% of the area of the surface 142 on the valve member 120.

The valve member 120 is restrained against latteral movement of the sidewalls **122*a* and 122*b* of the valve slideway 122, and is restrained against movement out of the slideway 122 by the overlapping engagement between the position maintaining surfaces 140 and 142 on the control slider 50 and the valve member 120.**

Valve elements are provided on the movable valve member 120 and also on the fixed casing 22, such valve elements being so constructed that fluid control functions will be performed by the movement of the valve member 120 along the valve slideway 122. A variety of valve elements may be employed. In the construction shown to best advantage in FIGS. 8, 9 and 11–17, the valve elements on the casing 22 take the form of valve ports 150 formed in the rear wall **122*c* of the valve slideway 122 and connecting with the hollow nipples 28. Thus, there are nine valve ports 150 connecting with the nine nipples 28. The exact number and arrangement of the valve ports 150 depends upon the control functions to be performed by the valve member 120.**

The valve elements on the valve member 120 may take the form of passage means for selectively interconnecting the valve ports 150 so as to control the operation of the vacuum operated components connected thereto. The detailed construction of the valve passages is subject to variation, depending upon the control functions which are desired.

By way of example, FIGS. 11–17 illustrate details of the valve member 120, which in this case comprises a slide valve element 152 mounted on a carriage 154. The slide valve element or slider 152 may comprise a sealing member 156 mounted on a backing plate or member 158. The sealing member or element 156 is preferably made of silicone rubber or some other suitable soft resiliant material. The backing plate 158 is preferably made of metal or some other relatively rigid material. The sealing member 156 is bonded or cemented to the backing plate 158.

Figure 11:
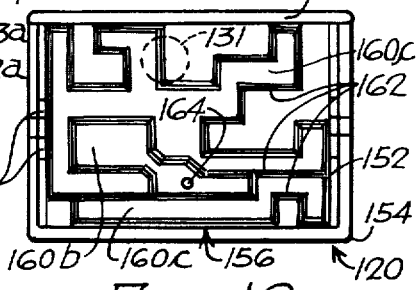
FIG. 11 is an enlarged rear view of the valve member.
Figure 8:
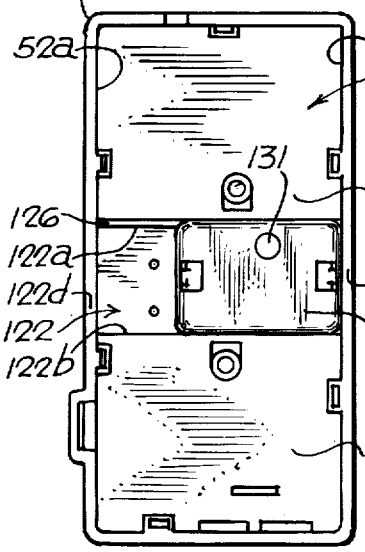
FIG. 8 is a front view of the control device with the front cover plate and the electrical slider removed, to show details of the casing and the valve slider.

One or more passages are formed in the sealing member 156 to afford selective communication between the valve ports 150. As shown in FIG. 11, this particular sealing member 156 is formed with three separate passages in the form of channels or grooves **160*a*, *b* and *c*, bounded by ridges 162 projecting rearwardly on the sealing member 156. It will be seen from FIGS. 15–17 that the ridges 162 are slidable along the rear wall 122*c*, in which the valve ports 150** are formed.

Figure 9:
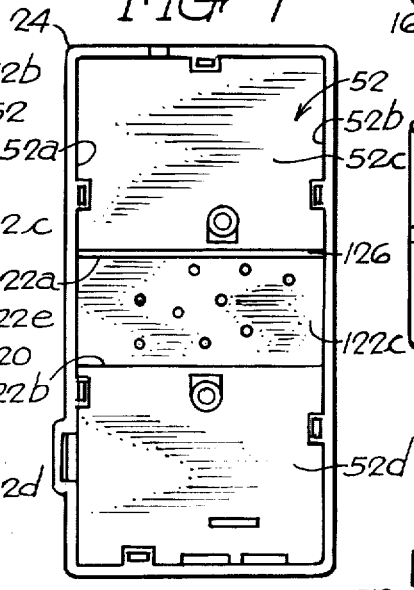
FIG. 9 is a front view of the casing with the front cover plate, the electrical slider and the valve member removed.

The exact configuration of the ridges 162 and the valve passages **160*a*, *b* and *c* is subject to variation, depending upon the desired functions which are to be carried out by the valve member 120. FIG. 11 shows the configuration of the passages 160*a*, *b* and *c* and also the configuration of the ridges 162. The corresponding layout of the valve ports 150 is shown in FIG. 9. It will be seen from FIG. 11 that the sealing member 156 is formed with a vent passage 164, connecting with the passage or groove 160*b*. The vent passage 164 is aligned with one of a pair of vent passages or holes 166 in the backing plate 158.**

The valve member 122 is preferably provided with means for biasing the slide valve element 152 rearwardly into sealing engagement with the rear wall **122*c* in which the valve ports 150 are formed. As shown in FIG. 16, a biasing spring 170 is provided between the carriage 154 and the backing plate 158 of the slide valve element 152. The spring 170 presses the slide valve element 152 against the rear wall 122*c*, while pressing the carriage 154 against the main control slider 50. The position maintaining surface 142 is formed on the carriage component 154 of the valve member 122. It will be seen that a spring socket or locating element 172 is formed on the carriage 154, as shown to best advantage in FIGS. 12 and 16.**

Figure 12:
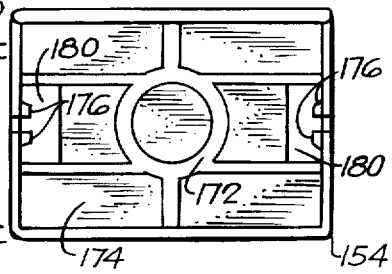
FIG. 12 is an enlarged rear view of the valve member, with the slide valve element removed.
Figure 13:
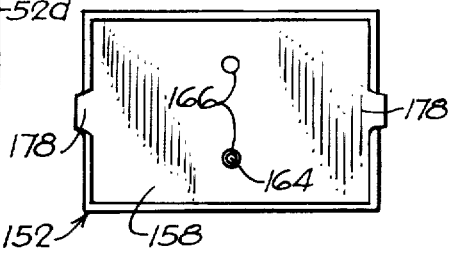
FIG. 13 is a view of the front or opposite side of the slide valve element from that shown in FIG. 11.
Figure 14:
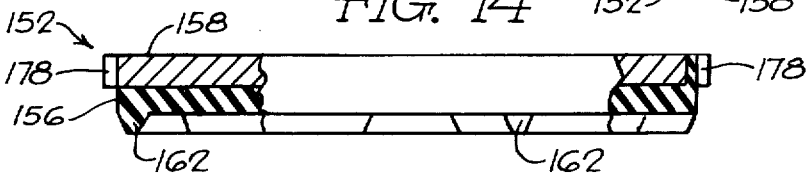
FIG. 14 is an enlarged edge view of the slide valve element, shown partly in longitudinal section.

The slide valve element 154 is movably received in an opening or cavity 174 formed in the carriage 154. To facilitate the assembly of the valve member 120, the carriage 154 is preferably provided with means for retaining the slide valve element 152 in the cavity 174. As shown in FIGS. 12 and 13, such means may comprise inwardly projecting lips or barbs 176 on the carriage 154. Such lips 176 are adapted to engage and retain tabs 178 which project laterally from the valve backing plate 158. The carriage 154 is preferably made of a sufficiently flexible material to enable the tabs 178 to be pushed past the lips 176. Thus, the carriage 154 may be made of a suitable resinous plastic material.

The illustrated carriage 154 if formed with vent passages 180 connecting with the cavity 174, so that the slide valve element 152 will be freely movable in the cavity 174. The vent passages 180 prevent any pressure or vacuum from developing in the cavity 174.

It will be evident that the position and the orientation of the valve member 120 in the valve slideway 122 are maintained by the overlapping engagement of the relatively slidable surfaces 140 and 142 on the control slider 50 and the valve member 120. This is true throughout the entire range of sliding movement of the slider 50, and also throughout the entire range of movement of the valve member 120. The direct sliding engagement between the position maintaining surfaces 140 and 142 obviates any need for any additional element for maintaining the position of the valve member 120 in the slideway 122.

It is highly advantageous to employ the ingenious contact arrangement whereby the segments or tabs on the elongated contact members 92 and 93 project laterally in opposite directions into the path of one of the contact elements **82*c* on the contactor 72. This arrangement enables the contact element 82*c* to move into successive engagement with the alternate tabs or segments 92*a*, 93*a*, 92*b* and 93*b*. Meanwhile, the contact element 82*b* is continuously engaging the elongated contact member 92.** This contact arrangement makes it possible to perform a variety of switching functions.

It is particularly advantageous that the contact element **82*c* on the contactor 72 moves sequentially between the tabs or segments 92*a*, 93*a*, 92*b* 93*b*, without ever engaging the insulating material of the rear wall 52*e*. It will be seen from FIGS. 6 and 7 that the tabs or segments 92*a*, 93*a*, 92*b* and 93*b* have narrow gaps therebetween, and that the width of each gap is less than the width of the contact element or point 82*c*, so that the contact point will ride between the successive segments without engaging the insulating wall 52*e*. Thus, the contact element 82*c* stays clean and free from any contamination by residue of the insulating material. Any arcing takes place between the copper contact element 82*c* and the copper tabs or segments 92*a*, 93*a*, 92*b* and 93*b*,** so that there is very little or no tendency for the insulating material to be burned by such arcing.

We claim:

1. An electrical switching device, comprising a casing, a control member movable in said casing along a predetermined path, a conductive contactor mounted on said control member and movable therewith, said contactor having first and second contact points movable along first and second paths, said casing having an electrically insulating wall opposite said contactor, and first and second elongated conductive contact bar members mounted on said insulating wall opposite said contactor, said first contact bar member extending along said first path and being engageable by said first contact point on said contactor, said first and second contact bar members having first and second segments thereon projecting laterally in opposite directions into said second path and disposed alternately along said second path for successive engagement by said second contact point on said contactor, said first and second segments having a narrow gap therebetween of less width than the width of said second contact point whereby said second contact point will ride between said first and second segments without engaging said insulating wall to avoid burning of said insulating wall and to avoid contamination of said second contact point by said insulating wall.

2. A device according to claim 1, in which said first segment is one of a plurality of such first segments on said first contact bar member projecting laterally in one direction into said second path, said second segment on said second contact bar member being one of a plurality of such second segments on the second contact bar member projecting laterally in the opposite direction into said second path.

said first segments alternating with said second segments along said second path for successive engagement by said second contact point on said contactor, said first and second segments having successive narrow gaps therebetween of a width less than the width of said second contact point.

3. A device according to claim 1, including resilient means for biasing said contactor toward said casing for resilient engagement with said first and second members.

4. A device according to claim 1, in which said first and second contact members are in the form of elongated conductive strips, said segments being in the form of tabs projecting laterally from said strips.

5. An electrical switching device, comprising a casing, a control member movable in said casing along a predetermined path, a conductive contactor mounted on said control member and movable therwith, said contactor having a contact point movable along a second path, means for feeding electrical current to said contactor, said casing having an electrically insulating wall opposite said contactor, and first and second elongated conductive contact bar members, mounted on said insulating wall opposite said contactor, said first and second contact bar members having first and second segments thereon projecting laterally in opposite directions into said second path and disposed alternately along said second path fur successive engagement by said contact point on said contactor, said segments having a narrow gap therebetween of less width than the width of said contact point whereby said contact point rides between said segments without engaging said insulating wall to avoid contamination of said contact point by said insulating wall and to avoid burning of said insulating wall.

6. A device according to claim 5, in which said first segment is one of a plurality of such first segments on said first contact bar member and projecting laterally in one direction into said second path, said second segment on said second contact bar member being one of a plurality of such second segments on said second contact bar member and projecting laterally in the opposite direction into said second path, said first segments alternating with said second segments along said second path for successive engagement by said contact point on said contactor, said successive first and second segments having successive narrow gaps therebetween of less width than the width of said contact point whereby said contact point rides between the successive segments without engaging said insulating wall.

* * * * *